US005755591A

United States Patent [19]

Takahashi et al.

[11] Patent Number: 5,755,591

[45] Date of Patent: May 26, 1998

[54] BRANCH UNIT STRUCTURE FOR AN INPUT UNIT AND AN OUTPUT UNIT IN A SEQUENCER

[75] Inventors: Keiji Takahashi, Kiryu; Tamaki Nishimura, Isesaki, both of Japan

[73] Assignee: Mitsuba Corporation, Kiryu, Japan

[21] Appl. No.: 514,098

[22] Filed: Aug. 11, 1995

[51] Int. Cl.[6] ..... H01R 13/518

[52] U.S. Cl. ..... 439/540.1

[58] Field of Search ..... 439/502, 505, 439/540.1, 76, 638, 639, 640, 650, 651, 654

[56] References Cited

U.S. PATENT DOCUMENTS 4,217,023 8/1980 Petit et al. ..... 439/540.1
4,923,411 5/1990 Hayashi et al. ..... 439/540.1
5,454,733 10/1995 Watanake et al. ..... 439/540.1
5,531,611 7/1996 Reed et al. ..... 439/540.1

FOREIGN PATENT DOCUMENTS 7-36161 7/1995 Japan .

*Primary Examiner*—J. J. Swann
*Attorney, Agent, or Firm*—Oliff & Berridge, PLC

[57] ABSTRACT

A branch unit structure for an input unit and an output unit in a sequencer makes it possible to directly connect an external power supply to the input unit and the output unit of the sequencer, by using an external power supply connection terminal board. This prevents unstable operation of the input unit and the output unit caused by a voltage drop and allow use of connecting cables of any length. A terminal board, capable of allowing direct external power supply to be connected to the secondary circuits of the input unit and output unit, is provided on the branch unit, to allow connection of a plurality of input and output device groups to a single input unit and output unit.

27 Claims, 10 Drawing Sheets

BRANCH UNIT STRUCTURE FOR AN INPUT UNIT AND AN OUTPUT UNIT IN A SEQUENCER

BACKGROUND OF THE INVENTION

1. Field of the Invention

The present invention relates to a branch unit structure for an input unit and an output unit in a sequencer comprising a general-purpose sequence control device.

2. Description of the Related Art

In general, this type of sequencer has a base unit (control box). Mounted to the base unit are a sequencer body incorporating a central processing unit (CPU) and memory, an input unit incorporating an input interface circuit, an output unit incorporating an output interface circuit, an external power supply unit for supplying electrical power to the input unit and the output unit and to input and output devices, and the like. Various input devices (detection switch, etc.) are connected to the input unit via connecting cables, while various output devices (solenoid, etc.) to be controlled are connected to the output unit through connecting cables.

To reduce the size and cost of these units, some of the input and output units, which are not equipped with terminal blocks for connecting the unit to the external power supply, have all of their connection points (input and output device connection points and external power supply connection points) connected by connectors. For easier solder connection of the cable to the connector, in some connecting cables multi-cored flat cables are press-contacted all together by a connector.

In the conventional sequencer, when the input and output units and connecting cables are used, it is not possible to connect the input and output units directly to the external power supply. Thus, as illustrated in FIG. 7, the external electrical power supplied to the input and output device side needs to be returned to the input and output units via the connecting cables. Therefore, the external power supply path to the input and output units becomes longer and electrical power must pass through smaller diameter multi-cored flat cables, so that a large voltage drop occurs. This may cause unstable operation of the input and output units as well as not allow connecting cables of any size to be used.

SUMMARY OF THE INVENTION

To overcome the above-described problems, the present invention provides a branch unit structure for an input unit and an output unit in a sequencer which has a connector provided for the input unit and output unit, the connector having input and output device connection points and external power supply connection points. The input unit and the output unit are connected to a sequencer body to allow connection of the input and output devices to this connector via connecting cables in which multi-cored flat cables are press-contacted all together to a connector. The branch unit structure, which allows connection of the plurality of input and output devices to the input unit and output unit connector, is provided with a single unit connection connector connectable to the connector of the input unit and the output unit, a plurality of cable connection connectors connectable to a connecting cable connector, and a printed board connecting the connection points of the single unit connection connector to the connection points of the cable connection connectors. An external power supply connection terminal board is mounted on the printed board and is connected to the external power supply connection points of the unit connection connector via the printed board.

With this arrangement, the present invention makes it possible to directly connect an external power supply to an input unit and an output unit which are not individually equipped with an external power supply connection terminal board. Constantly, unstable operation of the input unit and the output unit is prevented and connecting cables of any length can be used.

These and other features and advantages of the invention are described in or apparent from the following detailed description of the preferred embodiments.

BRIEF DESCRIPTION OF THE DRAWINGS

The preferred embodiments of this invention will be described in detail, with reference to the following figures, wherein.

DESCRIPTION OF THE PREFERRED EMBODIMENTS

Figure 7:
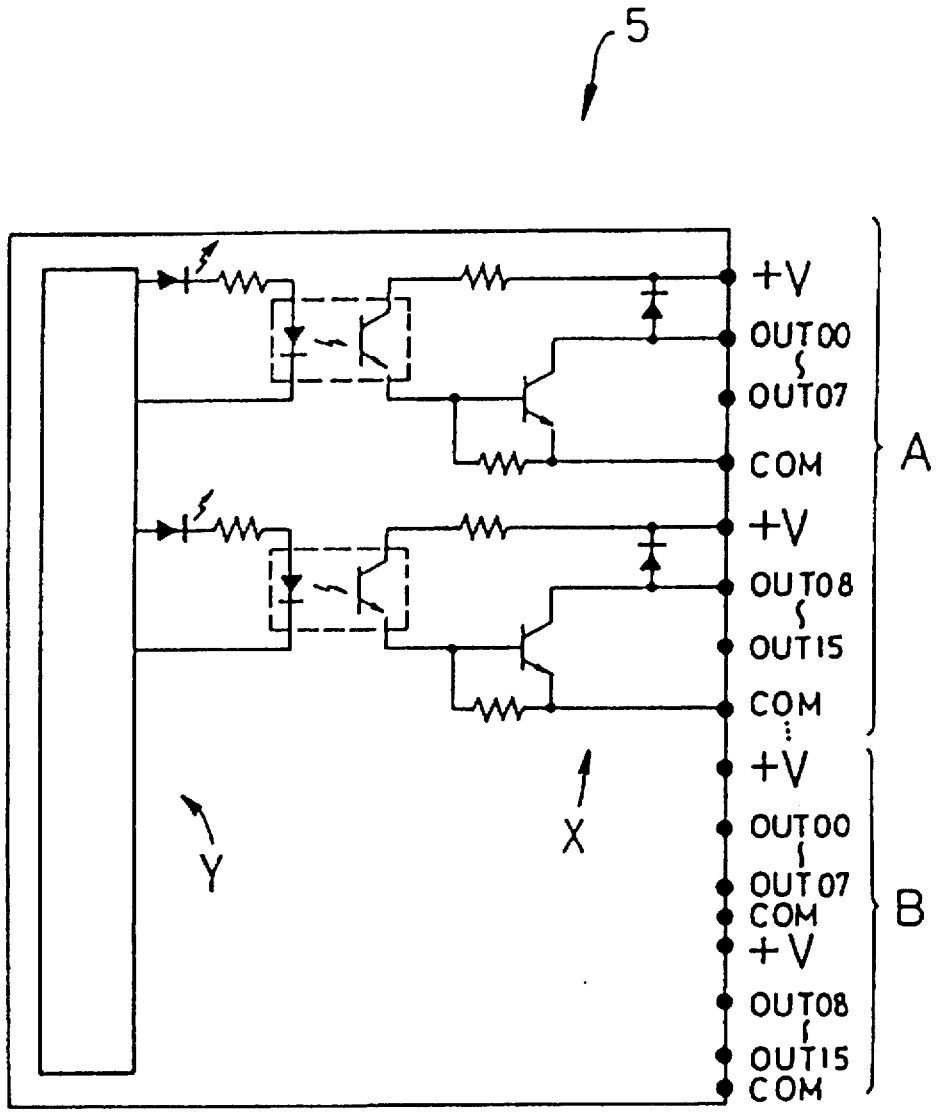
FIG. 7 is an output interface circuit diagram.

A description will now be given of a first preferred embodiment of the present invention with reference to the drawings. Referring to the figures, reference numeral 1 denotes a sequencer forming a general-purpose sequence control device. The sequencer 1 includes a control box 2. Mounted to the control box 2 are a sequencer body 3 incorporating a central processing unit (CPU) and memory, an input unit 4 incorporating an input interface circuit, an output unit 5 incorporating an output interface circuit, an external power supply unit 6 for supplying electrical power to the secondary circuits X (see FIG. 7) of the input unit 4 and the output unit 5 and the input and the output devices L (see FIGS. 8 and 9). This basic construction is the same as that of a conventional sequencer. In the sequencer 1, electrical power is supplied from a main power supply unit (not illustrated) to the sequencer body 3 and the primary circuits Y (see FIGS. 7) of the input unit 4 and the output device 5 to eliminate the effects of noise produced by the input and output devices L.

The input unit 4 and the output unit 5 incorporate 32 input and output interface circuits operating on photocoupler isolation. The secondary input and output interface circuits X are operated by current supplied from the external power supply unit 6. Power input lines (+V) and common lines (COM) (see FIG. 7) of the input and output interface circuits are provided for every set of eight interface circuits.

Figure 8:
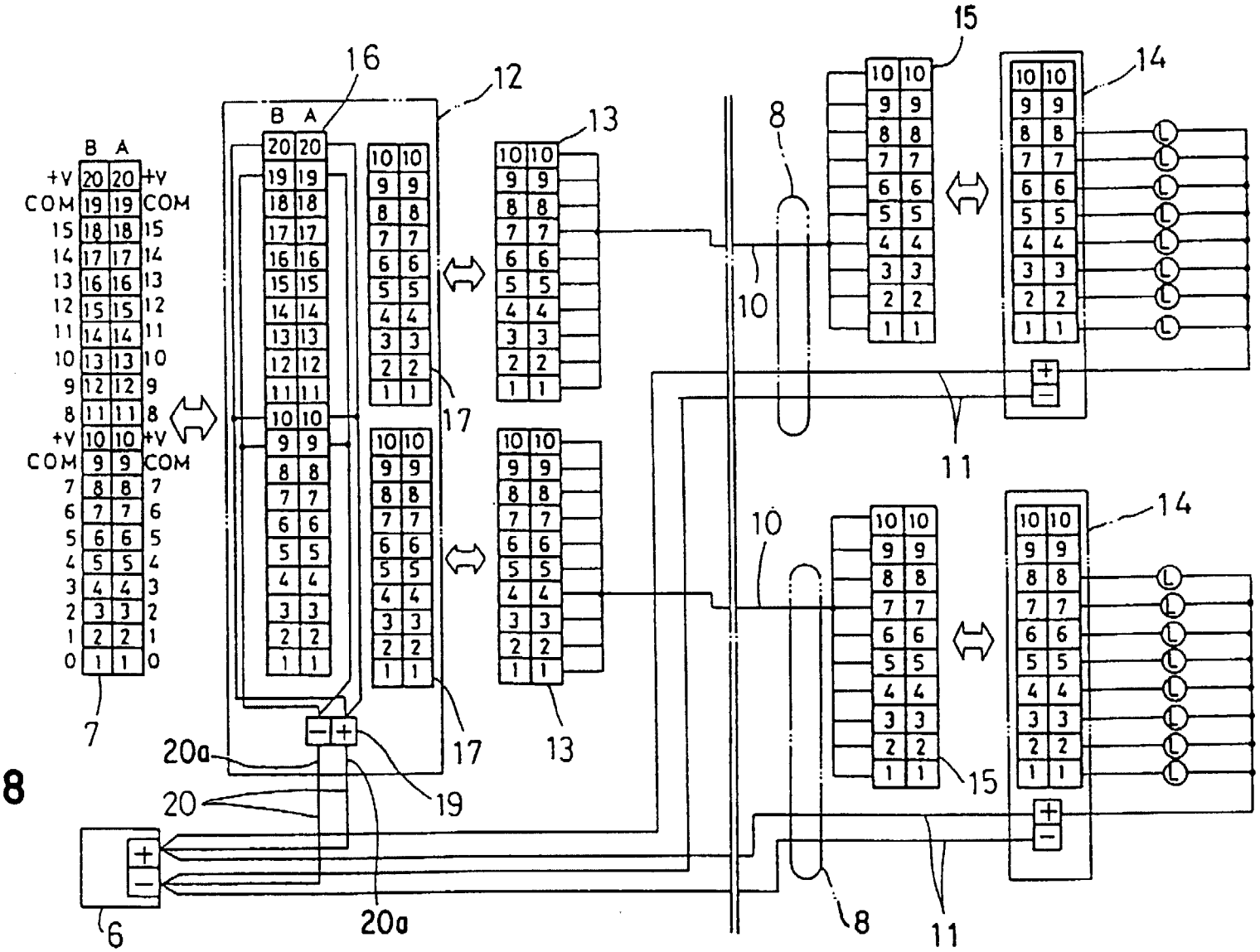
FIG. 8 is a wiring diagram illustrating a first embodiment of the present invention.
Figure 9:
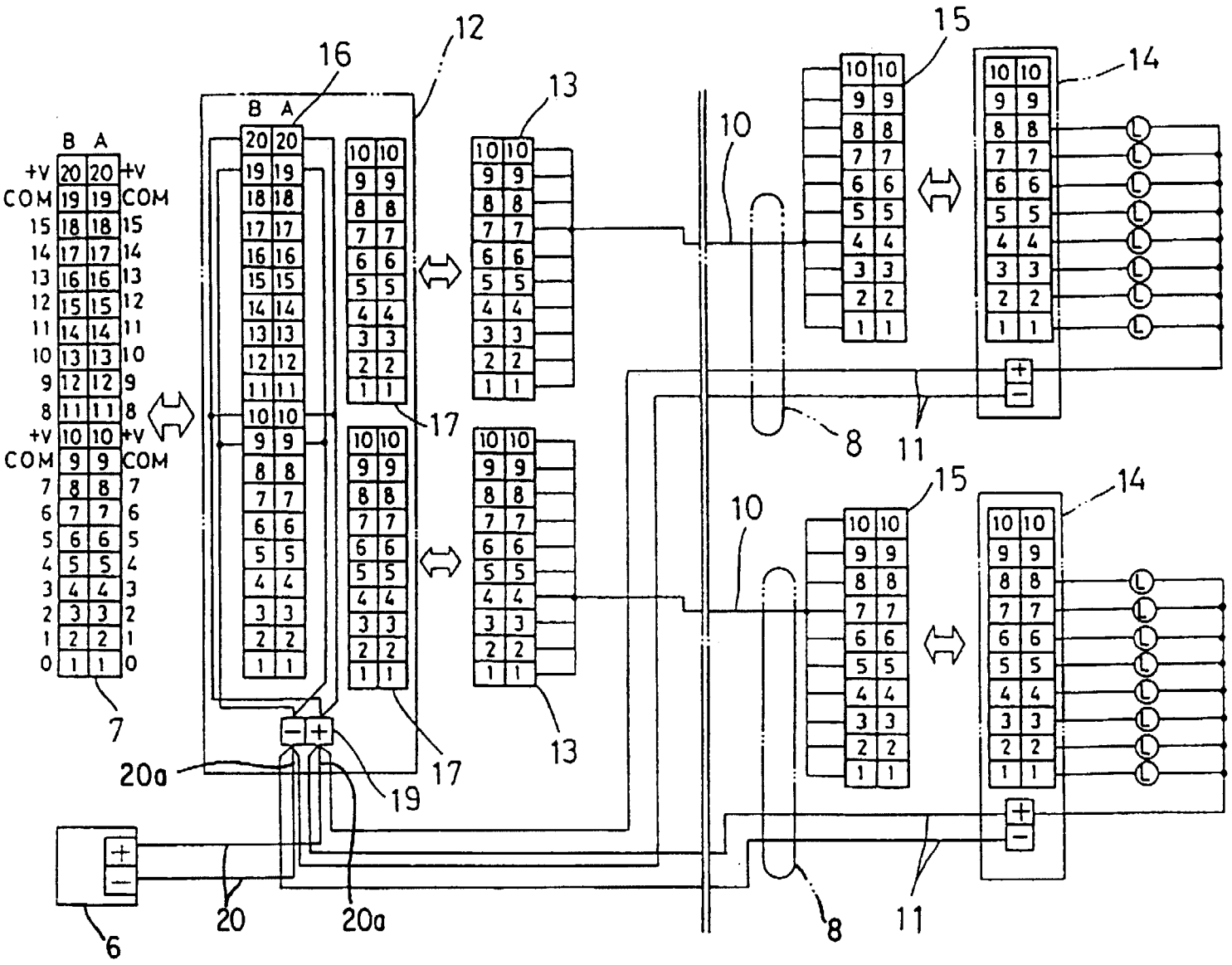
FIG. 9 is a wiring diagram illustrating a second embodiment of the present invention.
Figure 10:
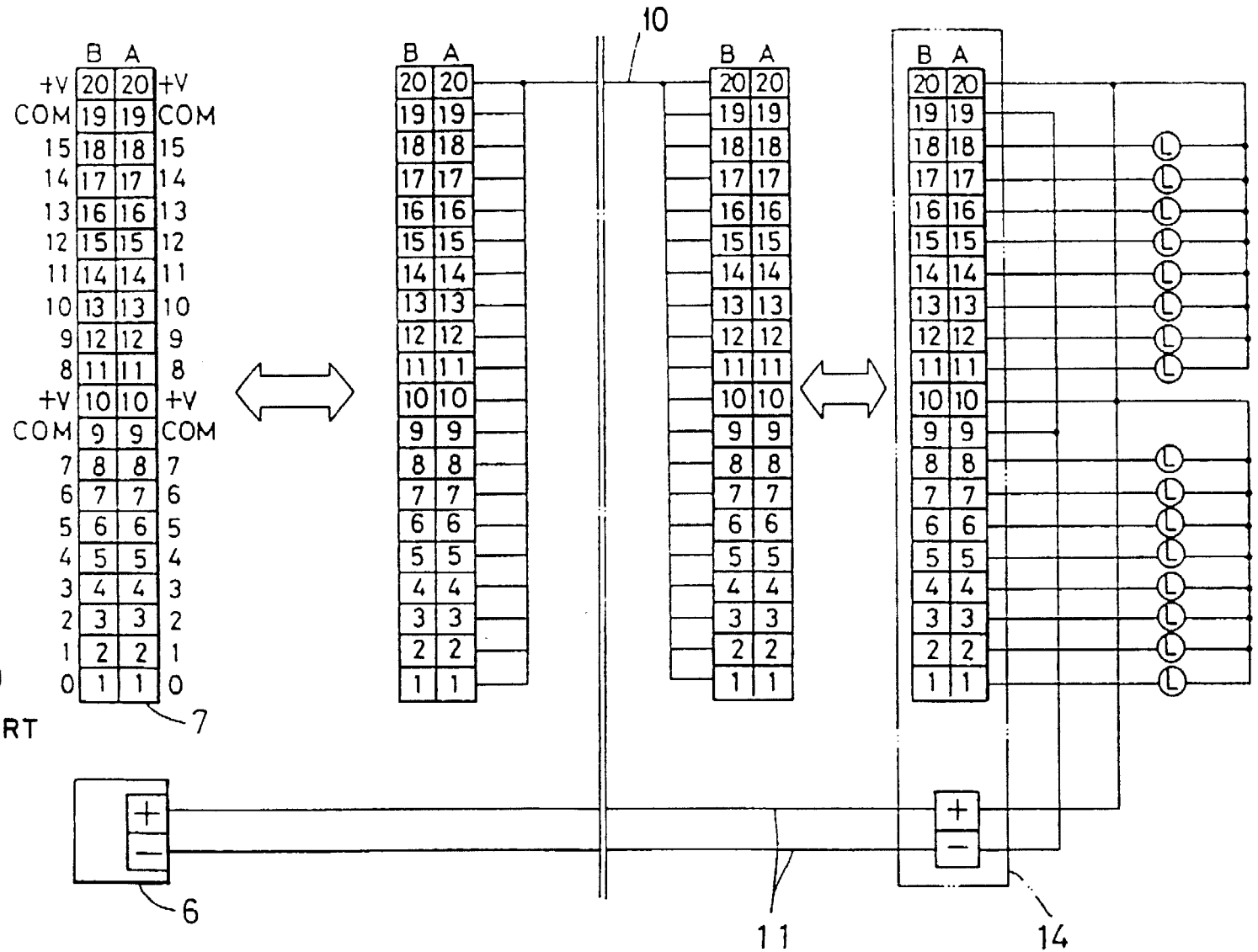
FIG.10 PRIOR ART
FIG. 10 is a wiring diagram of a conventional sequencer.

As shown in FIGS. 8 and 9, reference numeral 7 denotes a 40-pin connector provided for the input unit 4 and the output unit 5. The connection points (e.g., terminals or pins) of the connector 7 are connected to the 32 input and output lines of the input and output interface circuits, 4 power supply input lines, and 4 common lines in a predetermined arrangement.

Figure 1:
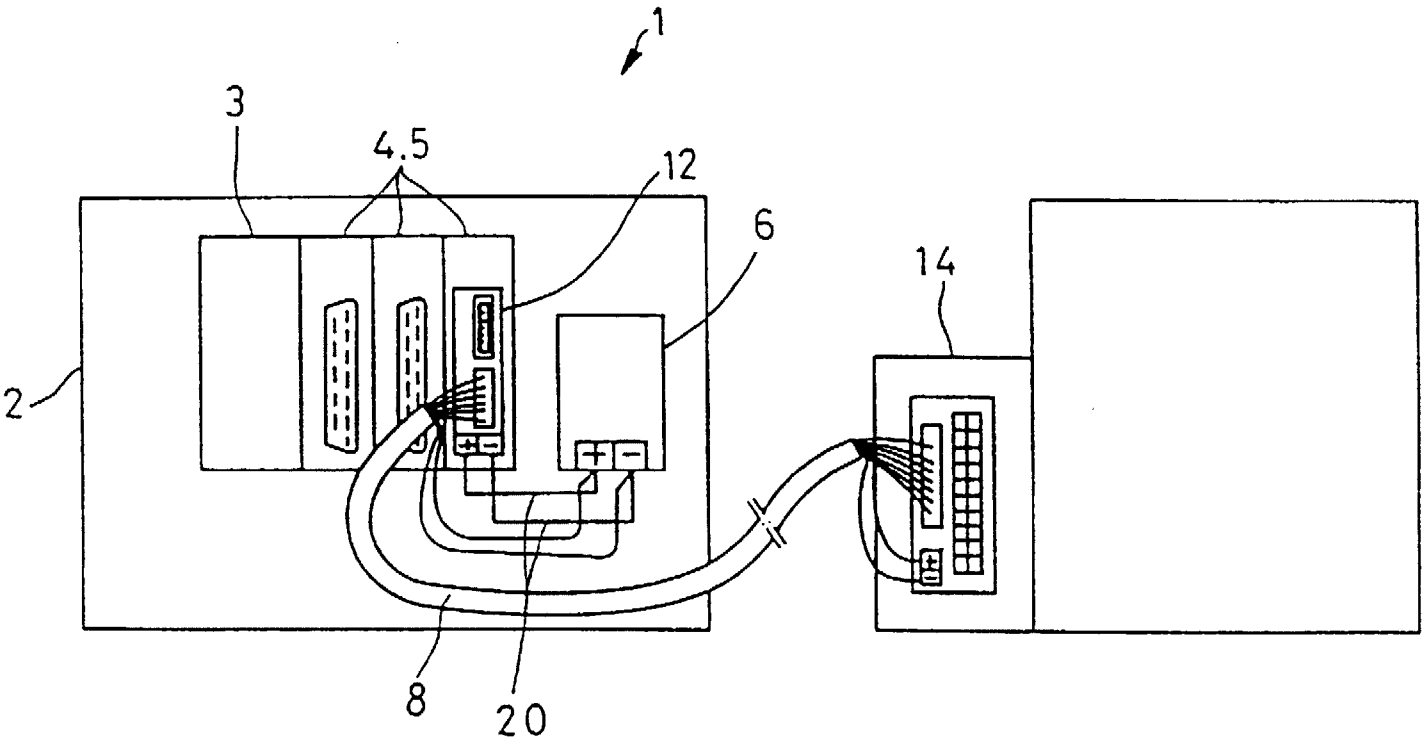
FIG. 1 is a front view of a sequencer.
Figure 2:
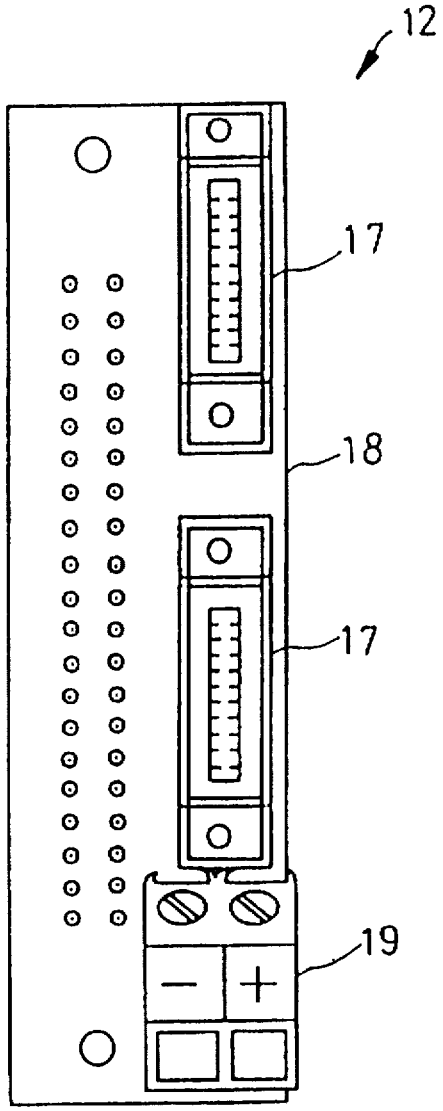
FIG. 2 is a front view of a branch unit.
Figure 6:
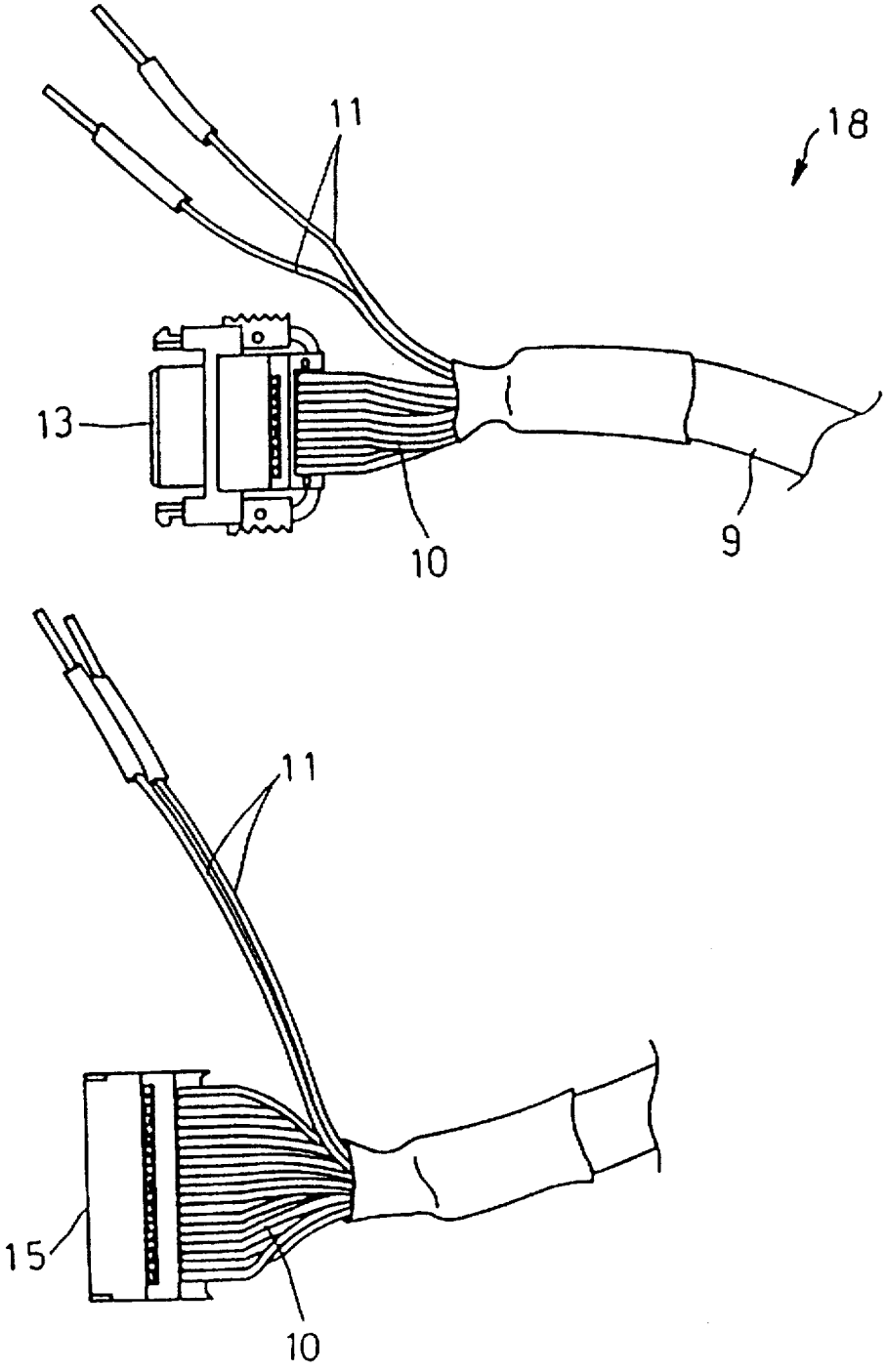
FIG. 6 is a plan view of a connecting cable.

As shown in FIG. 1, reference numeral 8 denotes a connecting cable for connecting the input devices and the output devices L to the input unit 4 and the output unit 5. As shown in FIG. 6, the connecting cable 8 is formed by inserting one or more 20-core flat cables 10 into a tube 9. Each of the 20-core flat cables 10 has both ends integrally formed into a flat shape. Each connecting cable 8 also has a pair of power supply cables 11 which are larger in diameter than the flat cables 10. One end of each flat cable 10 is provided with a connector 13 connectable to a branch unit 12, while the other end is provided with a connector 15 connectable to a relay unit 14. Each relay unit 14, which is an assembly of a connector for connecting each of the input unit 4 and the output unit 5 to the input and output devices L, a terminal board allowing connection to the external power supply unit 6, and a terminal board allowing connection to the input and output devices L, is provided with the necessary internal wirings. The connectors 13 and 15 press-contacted all together the flat cables 10 at the connection points. More specifically, the claws provided at the connection points (e.g., terminals or pins) of the connectors 13 and 15 pass completely through all of the flat cables at once to effect press-contacting of the cables to connect the flat cables and the connectors.

Figure 3:
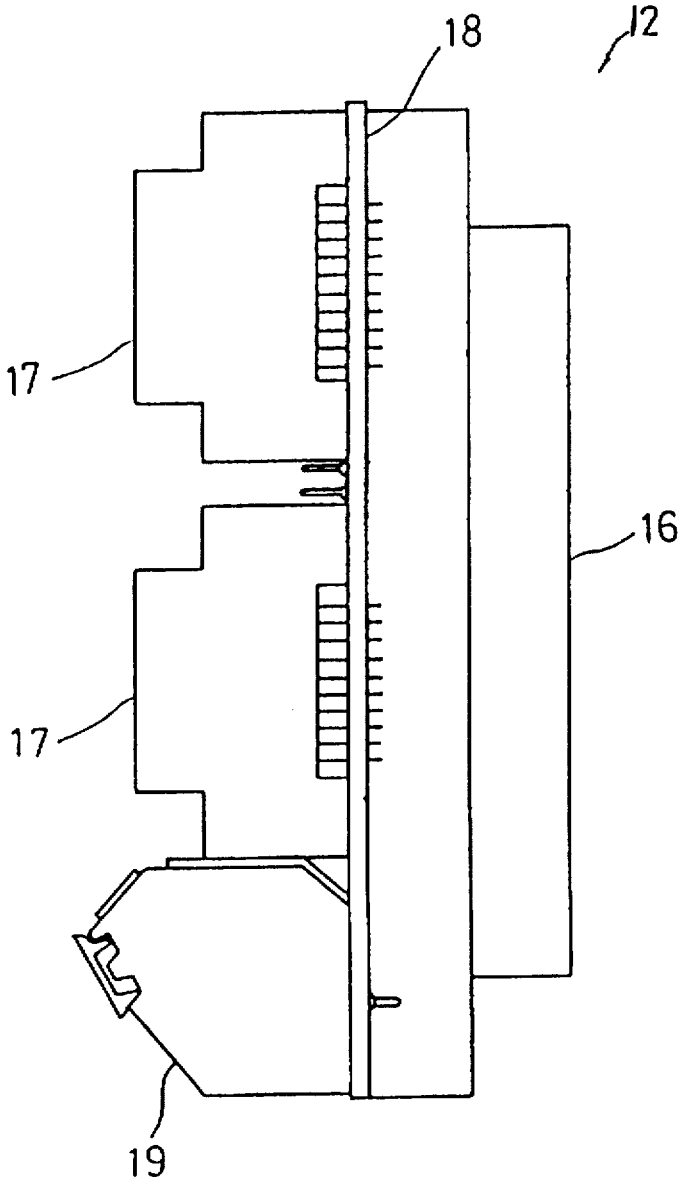
FIG. 3 is a side view of the branch unit.
Figure 4:
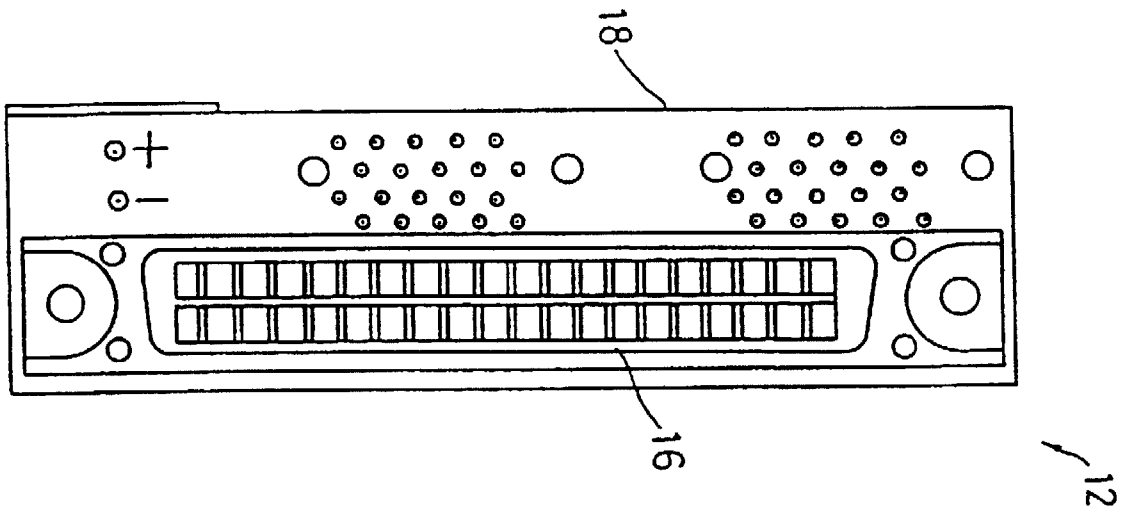
FIG. 4 is a back view of the branch unit.
Figure 5:
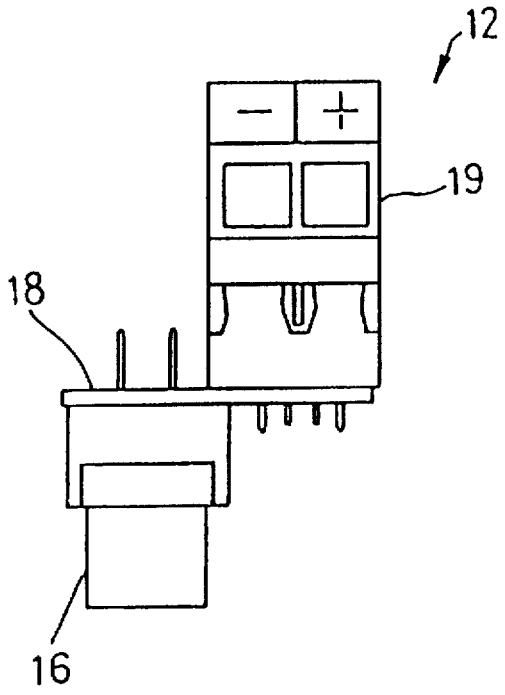
FIG. 5 is a bottom view of the branch unit.

The branch unit 12 is used to allow connection of a plurality (two in the second embodiment) of the input and output device groups L to the connector 7 of the input unit 4 and the output unit 5. To achieve connection, the branch unit 12 is provided with a single unit connection connector 16 (40-pin type) (see FIG. 3) connectable to the input unit 4 and the output unit 5, a pair of cable connection connectors 17 (20-pin type) connectable to the connectors 13 of the connecting cables 8, and a printed board 18 allowing connection of the connection points (e.g., terminals or pins) of the unit connecting connector 16 to the connection points (e.g., terminals or pins) of the cable connecting connectors 17. In other words, the unit connection connector 16 is provided on the back face of the printed board 18, while the pair of cable connection connectors 17 are vertically arranged on the front face of the printed board 18. An external power supply connection terminal board 19 is mounted on the lower end space of the printed board 18, which is made available by disposing the cable connecting connectors 17 upwardly of this space.

The external power supply connection terminal board 19 has a pair of connection points (e.g., terminals or pins) allowing connection of a terminal plate 20*a* in a nipped manner, the terminal plate 20*a* being provided at an end of a power supply cable 20. The positive and negative side connection points (e.g., terminals or pins) are connected to the external power supply connection points (+V and COM) of the single unit connection connector 16 via the printed board 18. More specifically, with the external power supply unit 6 connected to the terminal board 19 through the power supply cables 20, it is possible to directly supply external electrical power to the secondary input and output interface circuits X of the input unit 4 and the output unit 5.

As will be understood from the foregoing description of the first preferred embodiment of the present invention, when the input and output device groups L, which are disposed apart at two (or more) different locations, are connected to the single input unit 4 and output unit 5, the single unit connection connector 16, which is provided on the back face of the branch unit 12, is connected to the connector 7 of the input unit 4 and the output unit 5. At the same time, the input and output device groups L, which are disposed apart at two (or more) different locations, are connected to the pair of cable connection connectors 17, which are provided on the front face of the branch unit 12, via their respective connecting cables 8 and the relay unit 14. The power supply cables 11 within the connecting cables 8 are connected to the external power supply unit 6. The external power supply unit 6 is connected to the external power supply connection terminal board 19 via the power supply cables 20. The external power supply connection board 19 is provided on the branch unit 12. In other words, since the connection points (e.g., terminals or pins) of the external power supply connection terminal board 19 are connected to the external power supply connection points (e.g., terminals or pins) of the single unit connection connector 16 via the printed board 18 and the power supply cables 20, external electrical power is directly supplied to the secondary input and output interface circuits of the input unit 4 and the output unit 5.

Accordingly, although the sequencer 1 of the first preferred embodiment is an assembly of a compact input unit 4 and an output unit 5, each not having a terminal board for external power supply connection, and connecting cables 8 comprising flat cables 10 press-contacted together by the connectors 13, it is not necessary to return the external electrical power, supplied to the input and output devices L, to the input unit 4 and the output unit 5 via the connecting cables 8. Therefore, a much shorter external power supply path to the input unit 4 and the output unit 5 can be used. Accordingly, electrical power does not have to pass through the small-diameter flat cables 10. This makes possible stable operation of the input unit 4 and the output unit 5, with almost no voltage drop across the external power supply, and the use of connecting cables 8 having any length.

In addition, since the external power supply connection terminal board 19, which allows external electrical power to be directly supplied to the input unit 4 and the output unit 5, is provided on the branch unit 12, it is not necessary to construct a unit particularly for supplying power to the input unit 4 and the output unit 5. This contributes significantly to reducing the number of components used, simplifying the construction, reducing costs, and the like.

Further, the external power supply connection terminal board 19 is mounted on the lower end space of the printed board 18. The space is made available by placing the cable connection connectors 17 upwardly of this space, so that the branch unit 12 does not have to be made larger in size.

The use of the connecting cables 8 incorporating the power supply cables 11 makes it unnecessary to separately wire the power supply cables 11, thereby resulting in simple wiring as well as easier wiring operation.

It is obvious that the present invention is not limited to this first preferred embodiment. For example, as shown in a second preferred embodiment illustrated in FIG. 9, it is possible to wire the terminal board 19 mounted on the branch unit 12 to the input and output device side to supply power. In addition, although in the first preferred embodiment the single unit connection connector 16 was directly connected to the connector 7 for the input unit 4 and the output unit 5 to obtain space, the single unit connection connector 16 may be connected to the connector 7 via cables.

Accordingly, in the sequencer 1 of the second preferred embodiment of the present invention, the input and the output devices L are connected to the input unit 4 and the output unit 5 through the connecting cables 8 in which multi-cored flat cables 10 are press-contacted together by a connector 7. The external power supply connection terminal board 19 is provided on the branch unit 12. This allows connecting a plurality of the input and the output devices L to the input unit and output unit connector 7. The external power supply connection terminal board 19 is connected to the external power supply connection points (e.g., terminals or pins) for the single unit connection connector 16 via the printed board 18. Therefore, connection of the external power supply to the external power supply connection terminal board 19 permits direct supply of external electrical power to the input unit 4 and the output units. This obviates the problem of a large voltage drop occurring due to a longer external power supply path or due to the use of a small-diameter flat cable. This problem may otherwise arise when the external electrical power, supplied to the input and output device side, is returned to the input unit 4 and the output unit 5 via the connecting cables 8. Consequently, it is possible to prevent unstable operation of the input unit 4 and the output unit 5 as well as to use connecting cables 8 of any length.

The external power supply terminal board 19 provided on the branch unit 12 minimizes the number of components, simplifies the construction, and reduces costs, with the combined use of the units.

A plurality of input and output device groups L can be connected to the input unit and output unit connector 7 via the branch unit 12, thereby allowing much more efficient wiring of the input unit 4 and the output unit 5 and the input and output devices L. This also allows for the use of connectors with many connection points (e.g., terminal or pins) for the input unit 4 and the output unit 5. As a result, this allows for the provision of a more highly integrated input unit 4 and output unit 5 which is smaller in size.

While this invention has been described with reference to a preferred embodiment, this description is not intended to be construed in a limiting sense. Various modifications of the preferred embodiment, as well as other embodiments of the invention, will be apparent to those versed in the art upon reference to this description. It is, therefore, contemplated that the appended claims will cover any such modifications or embodiments as fall within the true scope of the invention.

What is claimed is:

1. A branch unit for an input unit and an output unit of a sequencer, the input unit and the output unit attached to a sequencer body of the sequencer, the sequencer having an input/output connector for the input unit and the output unit, the input/output connector having input and output device terminals and external power supply terminals, input devices and output devices electrically connectable to the input/output connector via connecting cables having cable connectors, said branch unit allowing connection of said input devices and said output devices to said input unit and said output unit via the input/output connector and comprising:

a first connector connectable to the input/output connector and having first terminals and external power terminals;

a plurality of second connectors each connectable to the cable connectors and having second terminals;

a printed board electrically connecting the first terminals of the first connector to the second terminals of the plurality of second connectors; and an external power supply connection device mounted to the printed board and having external power connection terminals electrically connected to the external power supply terminals of the first connector via the printed board.

2. The branch unit of claim 1, wherein the first connector is connected directly to the input/output connector.

3. The branch unit of claim 1, wherein the first connector is connected to the input/output connector by at least one second connecting cable.

4. The branch unit of claim 1, wherein each connecting cable further comprises power supply wires connectable to one of the external power supply connection device and an external power supply.

5. The branch unit of claim 1, wherein the sequencer further comprises an external power supply, the external power supply connection device connectable to the external power supply.

6. A branch unit for an input unit and an output unit of a sequencer, the input unit and the output unit attached to a sequencer body of the unit and the sequencer having an input/output connector for the input unit and the output unit, the input/output connector having input and output device terminals and external power supply terminals, input devices and output connector, said branch unit allowing connection of said devices and said output devices to said input unit and said output unit via the input/output connector and comprising:

a printed board;

a first connector connected to the input/output connector and having first terminals and external power supply terminals;

a plurality of second connectors connected to the input devices and the output devices, each having second terminals, the first terminals of the first connector electrically connected to the second terminals of the plurality of second connectors by the printed board; and an external power supply connector separate from the plurality of second connectors and having external power supply connection terminals electrically connected to the external power supply terminals of the first connector by the printed board.

7. The branch unit of claim 6, wherein the external power supply connector is an external power supply terminal board.

8. The branch unit of claim 6, wherein the external power supply connector is connectable to an external power supply to provide a supply power to the external power supply terminals of the first connector.

9. The branch unit of claim 6, wherein the sequencer comprises:

an input unit having input device terminals and external power supply terminals;

an output unit having output device terminals and external power supply terminals; and a connector connected to the input unit and the output unit and having input device and output device terminals connected to the input device and output device terminals of the input unit and the output unit and external power supply terminals connected to the external power supply terminals of the input unit and the output unit;

wherein the first connector is connectable to the connector of the sequencer to supply power from the external power supply to the input unit and the output unit.

10. The branch unit of claim 9, wherein the first connector is connected to the connector of the sequencer by a cable.

11. The branch unit of claim 9, wherein the first connector is directly connected to the connector of the sequencer.

12. The branch unit of claim 9, wherein the sequencer further comprises a body, the input unit and the output unit being mounted on the body.

13. The branch unit of claim 6, wherein the sequencer comprises the external power supply, the external power supply connector connected to the external power supply.

14. The branch unit of claim 6, wherein each of the plurality of second connectors is connected to a first cable connector of a connecting cable, a second cable connector of the connecting cable connectable to a relay unit connectable to at least one of at least one input device and at least one output device, the connecting cable further comprising power supply wires connectable to the relay unit and to one of the external power supply and the external power supply connector, wherein power is supplied to the at least one of the at least one input device and the at least output device through the power supply wires and the relay unit.

15. A sequencer, comprising:

a body;

an input unit attached to the body and having input device terminals and external power supply terminals;

an output unit attached to the body and having output device terminals and external power supply terminals;

an external power supply;

an input/output connector connected to the input unit and the output unit and having input/output terminals connected to the input device terminals and the output device terminals of the input unit and the output unit, and external power supply terminals connected to the external power supply terminals of the input unit and the output unit; and a branch unit, comprising:

a first connector connected to the input/output connector of the sequencer and having first terminals connected to the input/output terminals of the input/output connector and external power supply terminals connected to the external power supply terminals of the input/output connector, a printed board, the first connector mounted on the printed board, a plurality of second connectors, each mounted to the printed board and having second terminals connected by the printed board to the first terminals of the first connector, and an external power supply connector mounted on the printed board, connected to the external power supply by a power supply cable and having external power supply connection terminals connected by the printed board to the external power supply terminals of the first connector to supply power to the input unit and the output unit.

16. The sequencer of claim 15, further comprising connection cables, each connection cable comprising:

at least one multi-wire cable;

a cable connector at each end of each at least one multi-wire cable; and a plurality of separate power supply wires;

wherein a first one of the cable connectors of each of the connection cables is connected to one of the plurality of second connectors of the branch unit, and one end of each of the plurality of power supply cables of each of the connection cables is connected to one of the external power supply and the external power supply connector.

17. The sequencer of claim 16, wherein a second one of the cable connectors of each of the connection cables and a second end of each of the plurality of power supply wires of each of the connection cables is connected to a relay unit, wherein the relay unit is connected to at least one of at least one input device and at least one output device.

18. The sequencer of claim 15, wherein the external power supply connector is an external power supply terminal board.

19. The sequencer of claim 15, wherein the input/output connector of the sequencer is connected to the first connector of the branch unit by a connection cable.

20. A branch unit for an input unit and an output unit of a sequencer, the input unit and the output unit attached to a sequencer body of the sequencer, the sequencer having an input/output connector for the input unit and the output unit, the input/output connector having input and output device terminals and external power supply terminals, input devices and output devices electrically connectable to the input/output connector via connecting cables, said branch unit allowing connection of said input devices and said output devices to said input unit and said output unit via the input/output connector and comprising:

a first connector connectable to the input/output connector and having first terminals and external power terminals;

a plurality of second connectors each connectable to one of said input devices and output devices and having second terminals;

a printed board electrically connecting the first terminals of the first connector to the second terminals of the plurality of second connectors; and an external power supply connection device mounted to the printed board and having external power connection terminals electrically connected to the external power supply terminals of the first connector via the printed board.

21. The branch unit of claim 20, wherein the first connector is connected directly to the input/output connector.

22. The branch unit of claim 20, wherein the first connector is connected to the input/output connector by at least one connecting cable.

23. The branch unit of claim 22, wherein each connecting cable further comprises power supply wires connectable to one of the external power supply connection device and an external power supply.

24. The branch unit of claim 20, wherein the sequencer further comprises an external power supply, the external power supply connection device connectable to the external power supply.

25. The branch unit of claim 20, wherein each second connector is connected directly to one of said input devices and said output devices.

26. The branch unit of claim 20, wherein each second connector is connected to one of said input devices and said output device by a connecting cable.

27. The branch unit of claim 26, wherein each connecting cable further comprises power supply wires connectable to one of the external power supply connection device and power supply terminals of said one of said input devices and said output devices.

* * * * *